US010830006B2

(12) United States Patent
Cheng et al.

(10) Patent No.: US 10,830,006 B2
(45) Date of Patent: Nov. 10, 2020

(54) CENTRALIZING AND PROTECTING SABOT

(71) Applicant: Vetco Gray, LLC, Houston, TX (US)

(72) Inventors: Samuel Heung Yeung Cheng, Katy, TX (US); Kevin O'Dell, Houston, TX (US); Gregory Dunn, Houston, TX (US); Joseph Pallini, Houston, TX (US)

(73) Assignee: VETCO GRAY, LLC, Houston, TX (US)

( * ) Notice: Subject to any disclaimer, the term of this patent is extended or adjusted under 35 U.S.C. 154(b) by 82 days.

(21) Appl. No.: 16/204,521

(22) Filed: Nov. 29, 2018

(65) Prior Publication Data

US 2020/0173240 A1 Jun. 4, 2020

(51) Int. Cl.

| | |
|---|---|
| ***E21B 17/10*** | (2006.01) |
| ***E21B 33/128*** | (2006.01) |
| ***E21B 33/12*** | (2006.01) |

(52) U.S. Cl.

CPC ..... *E21B 17/1078* (2013.01); *E21B 33/1208* (2013.01); *E21B 33/128* (2013.01)

(58) Field of Classification Search

CPC ..... E21B 33/03; E21B 33/04; E21B 33/128
See application file for complete search history.

(56) References Cited

U.S. PATENT DOCUMENTS

| | | | | |
|---|---|---|---|---|
| 4,900,041 | A * | 2/1990 | Hopkins | E21B 33/04 166/115 |
| 5,129,660 | A | 7/1992 | Taylor et al. | |
| 5,201,835 | A | 4/1993 | Hosie | |
| 5,215,145 | A | 6/1993 | Ross | |
| 5,735,344 | A | 4/1998 | Duncan | |
| 8,622,142 | B2 | 1/2014 | Shaw | |
| 8,997,883 | B2 | 4/2015 | Gette | |
| 2008/0135229 | A1 * | 6/2008 | Hunter | E21B 33/04 166/84.1 |
| 2011/0180275 | A1 | 7/2011 | Shaw | |
| 2011/0227296 | A1 | 9/2011 | Baca | |
| 2013/0008672 | A1 * | 1/2013 | Shaw | E21B 33/03 166/387 |

OTHER PUBLICATIONS

"Drilling & Production Systems Surface Wellhead & Tree Technology Update," General Electric, 2009, 25 pages.

International Search Report and Written Opinion dated Feb. 27, 2020 in PCT/US19/62970.

* cited by examiner

*Primary Examiner* — David J Bagnell
*Assistant Examiner* — Dany E Akakpo
(74) *Attorney, Agent, or Firm* — Hogan Lovells US LLP

(57) ABSTRACT

Embodiments include a system for setting a seal in a wellbore including a sabot arranged proximate the seal, the sabot being supported by the seal and having a first diameter larger than a second diameter of the seal. The system also includes a bridge coupled to the sabot and in contact with the seal, the bridge extending axially away from the sabot and positioned within a slot formed by an extension of the seal. The system also includes an energizing ring that drives legs of the seal radially outward, the energizing ring applying a radial force a leg proximate the sabot to at least partially deform the sabot

17 Claims, 5 Drawing Sheets

CENTRALIZING AND PROTECTING SABOT

BACKGROUND

1. Field of the Invention

This disclosure relates in general to oil and gas tools, and in particular, to systems and methods for sealing between components in wellbore operations.

2. Description of Related Art

In oil and gas production, different pieces of equipment may be utilized in a downhole environment in order to isolate sections of a wellbore. For example, casing may be installed along an outer circumferential extent of the wellbore and additional equipment, such as hangers and the like, may be installed. The hanger may be used to support wellbore tubulars utilized within the system. In operation, seals (e.g., elastomeric, metal, etc.) may be arranged between the downhole equipment in order to establish a variety of pressure barriers in order to direct fluid into and out of the well along predetermined flow paths. Seals may be "U" shaped and energized via an energizing ring that is driven into the U-opening to provide pressure to drive the seals against the wellbore components. Often, the seals include various components and extensions that may damage sealing surfaces along the hanger or casing.

SUMMARY

Applicant recognized the problems noted above herein and conceived and developed embodiments of systems and methods, according to the present disclosure, for protecting and centralizing sabots.

In an embodiment, a system for setting a seal in a wellbore includes a sabot arranged proximate the seal, the sabot being supported by the seal and having a first diameter larger than a second diameter of the seal. The system also includes a bridge coupled to the sabot and in contact with the seal, the bridge extending axially away from the sabot and positioned within a slot formed by an extension of the seal. The system also includes an energizing ring that drives legs of the seal radially outward, the energizing ring applying a radial force to a leg proximate the sabot to at least partially deform the sabot.

In an embodiment, a wellbore system includes a housing arranged circumferentially about a wellbore, a hanger arranged radially inward from the housing, and a sealing assembly between the housing and the hanger. The sealing assembly forms a pressure containing seal between the housing and the hanger and includes a seal positioned between the housing and the hanger, the seal having a first leg proximate the housing, a second leg proximate the hanger, and an opening. The sealing assembly also includes an energizing ring extending into the opening to drive the first leg and the second leg radially outward and into contact with the housing and the hanger, respectively. The sealing assembly also includes a sabot positioned radially outward from the first leg and at least partially within a recess formed in the first leg, the sabot having a first diameter greater than second diameter of the seal. The sealing assembly further includes a bridge coupled to the sabot and axially higher than the sabot, the bridge engaging at least a portion of the seal.

In an embodiment, a method for installing a downhole seal includes obtaining a seal assembly. The method also includes obtaining a sabot sized for use with the seal assembly. The method includes positioning the sabot circumferentially about a seal of the seal assembly. The method further includes installing the seal assembly within a wellbore. The method also includes activating the seal between at least two wellbore components.

BRIEF DESCRIPTION OF DRAWINGS

The present technology will be better understood on reading the following detailed description of non-limiting embodiments thereof, and on examining the accompanying drawings, in which.

DETAILED DESCRIPTION

Figure 1:
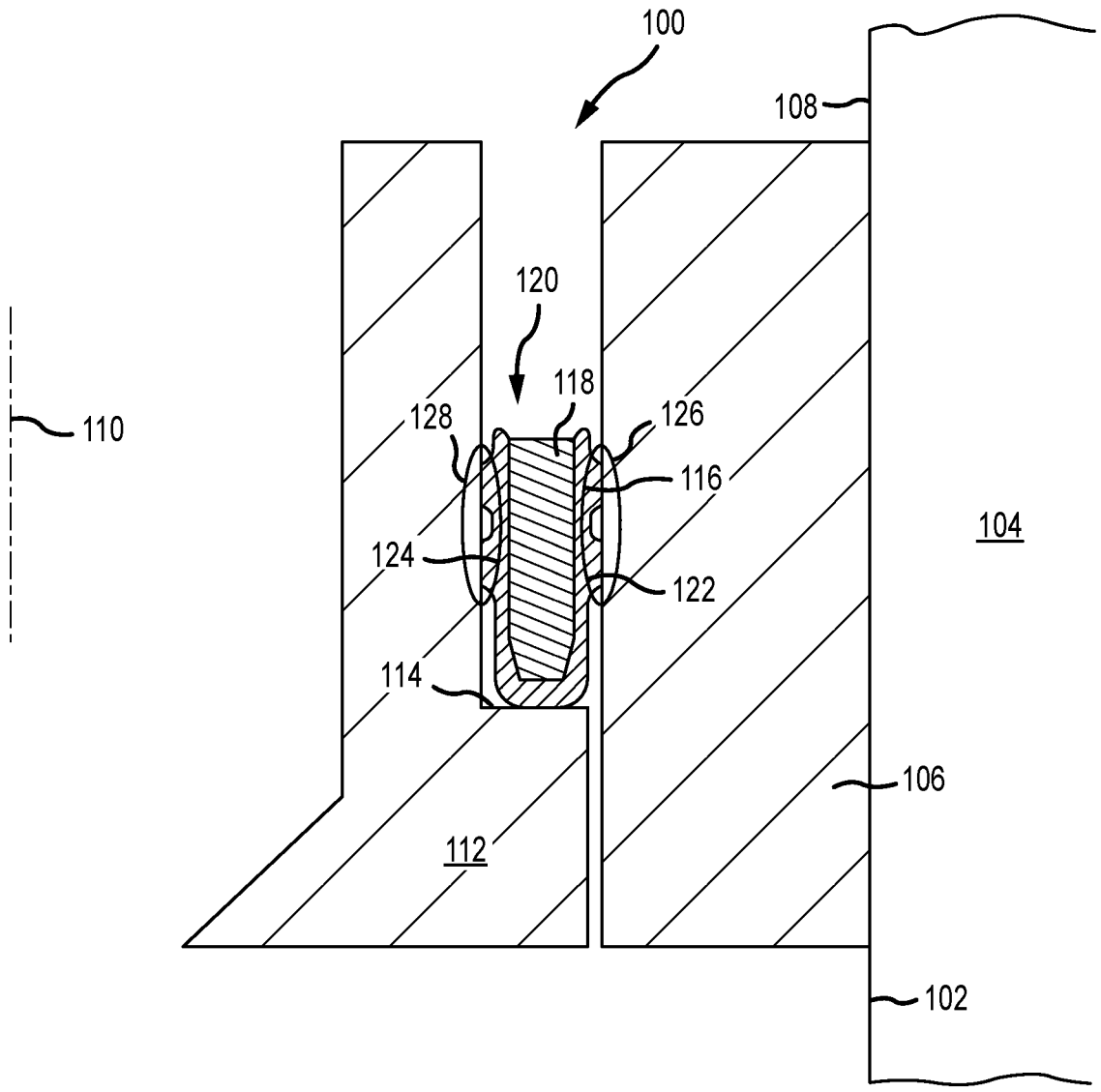
FIG. 1 is a cross-sectional side view of an embodiment of an energizing ring setting a seal, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions.

Embodiments of the present disclosure include a method for centralizing and protecting sealing surfaces during the running and/or retrieval of metal annular pack offs, using a sacrificial piece that has an outer diameter larger than that of the surfaces it is protecting. That is, the sacrificial piece protrudes beyond the surface it protects. This larger outer diameter snugly fits within the wellhead bore (e.g., drift diameter) and prevents the seal from cocking to one side and damaging the seal surface touching the wellhead bore.

In various embodiments, the protector may be referred to as a sabot and centralizes the metal annular packoff in the wellbore by having an outer diameter larger than the surfaces on the seal. This in turn physically prevents the surface from touching the corresponding bore. The sacrificial seal sabot is made of a softer material so that it does not damage the interfacing bore. That is, upon contact, the sabot will deform rather than damage the sealing surface. This sabot may be made as a solid ring made out of a polymer, composite, or metal that is skive cut to allow installation onto the seal. Moreover, the sabot could also be injection molded, cladded, or cast directly onto the seal body.

In various embodiments, the sabot acts as a centralizer that prevents the seal from being damaged during operation. Furthermore, the sabot acts as a wiper that removes debris in the seal pocket to maintain a clean sealing surface. In the case of a pressure energized seal, for example a wing type seal, the sabot can also be used to prop open the sealing wings. In various embodiments, the sabot maintains the wings in an outward position as the rest of the seal is set. During the seal setting, there may be plastic strains that can reduce the expansion of the pressure energized wing. Accordingly, in various embodiments, a secondary support (e.g., bridge) can be used to mechanically force the wing out so an initial seal is formed. The secondary support may be a static bridge or a spring loaded wedge that provides variable force based on the deformation. In various embodiments, secondary support may be a metallic ring that sits between the sealing wing and the seal body, so that as the seal is radially deformed, the secondary support forces the wing out. The secondary support may be split (e.g., skive/scarf) to allow the secondary support to radially expand without reduction in the cross section (due to Poisson's ratio and hoop stretch). In various embodiments, the secondary support is embedded in a polymer support that will also function as the seal centralizer.

FIG. 1 is a cross-sectional side view of an embodiment of a wellbore sealing system 100 arranged within a borehole 102 extending into a downhole formation 104. It should be appreciated that, for clarity with the discussion herein, various components of a well site that may include the borehole 102 have been eliminated. For example, the well site may include surface equipment, such as drilling rigs, wellhead components, and the like. In the illustrated embodiment, a housing 106 is arranged against a borehole wall 108 and radially outward with respect to a borehole axis 110. It should be appreciated that the borehole 102, housing 106, and various other components may be annular components that extend about the borehole axis 110. Furthermore, in various embodiments, the housing 106 may be a casing that is cemented to the borehole wall 108. It should be appreciated that, in various embodiments, the sealing system 100 may not be used within the borehole 102 and may, for example, be proximate the surface, such as within a wellhead assembly. For example, the housing 106 may include a test port that enables operators to test the effectiveness of the seal.

In the illustrated embodiment, a hanger 112 is arranged radially inward from the housing 106 and includes a shoulder 114 that receives the wellbore sealing system 100. The illustrated hanger 112 may receive one or more wellbore tubulars that are suspended into the borehole 102, for example, to recover hydrocarbons. The wellbore sealing system 100 illustrated in FIG. 1 includes a seal 116 that is a U-shaped cup. In operation, the seal 116 receives an energizing ring 118 within an opening 120 that drives legs 122, 124 of the seal 116 radially outward, for example with respect to an axis of the seal 116, such that a seal is formed between the hanger 112 and the housing 106. In various embodiments, the seal is formed from an elastomer, metal, composite material, or the like. However, for clarity with the present discussion, the seal 116 will be described as a metallic seal that forms a metal-to-metal seal between the hanger 112 and the housing 106.

In various embodiments, installation of the seal 116 into the borehole 102 may lead to damage to the sealing surfaces 126, 128 arranged along the hanger 112 and the housing 106. For example, if the seal 116 is tilted or off-center, it may scrape along the sealing surfaces 126, 128. As a result, the integrity of the seal may be reduced. Various embodiments of the present disclosure include a sabot for centralizing the seal 116 as well as facilitating energization of the seal 116.

Figure 2:
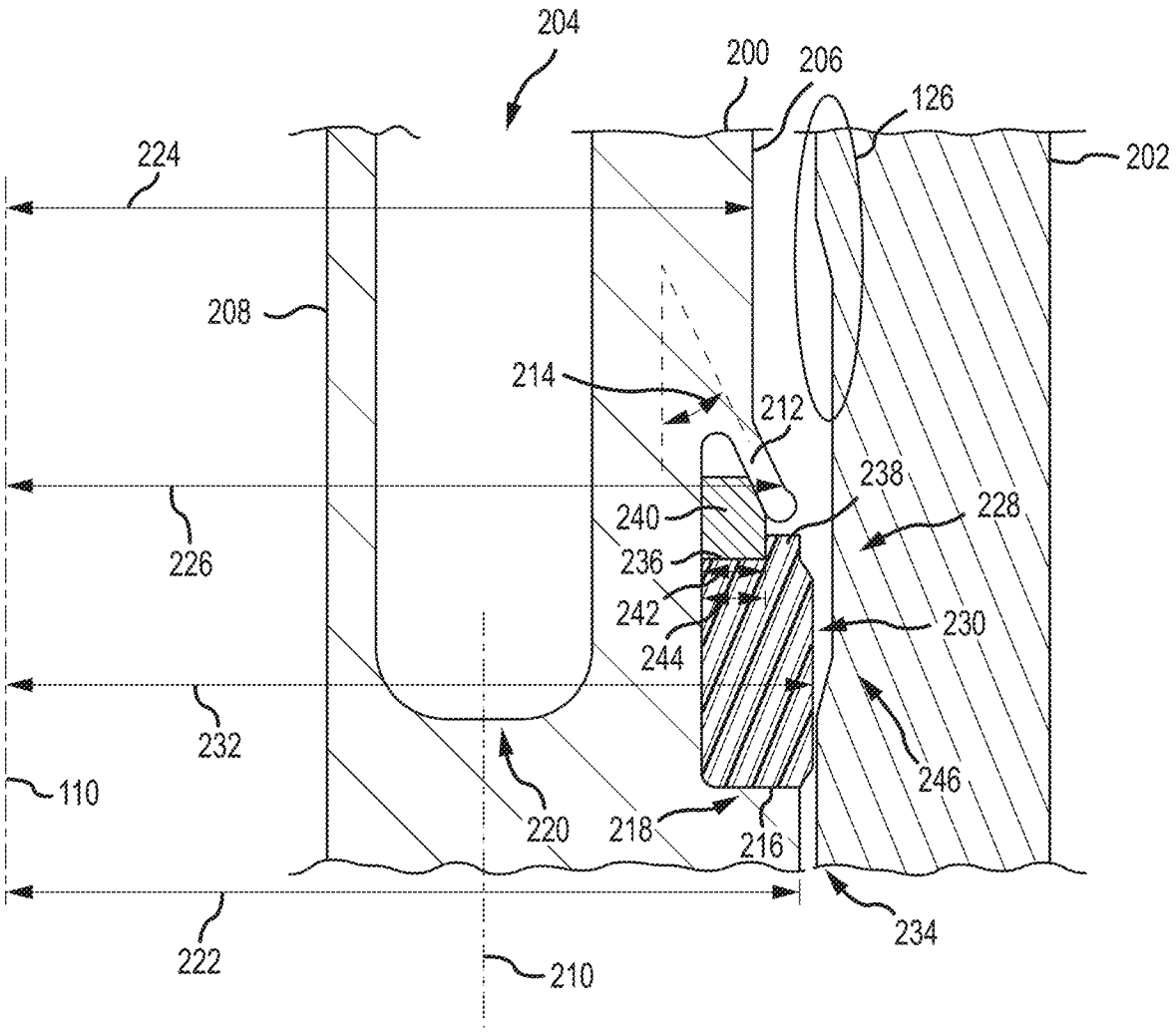
FIG. 2 is a cross-sectional side view of an embodiment of a seal including a sabot and bridge, in accordance with embodiments of the present disclosure.

FIG. 2 is a detailed cross-sectional view of an embodiment of a seal 200 arranged proximate a housing 202. The illustrated seal 200 is a U-type seal having an opening 204 that receives an energizing ring (not pictured) to drive legs 206, 208 of the seal 200 radially outward from an axis 210 to thereby form a seal between the hanger 112 (FIG. 1) and the housing 202. The illustrated seal 200 may be referred to as a wing-type seal because of the wing 212 that is positioned off of the leg 206 near the housing 202. The wing 212 is arranged at an angle 214 relative to the axis 210 and is flexible. That is, the wing 212 may be configured to expand or contract relative to the rest of the seal 200 based at least in part on pressures applied to the wing 212.

The seal 200 includes a shoulder 216 positioned at an outer edge 218 of the seal 200. The shoulder 216 is arranged below a bottom 220 of the opening 204 in the illustrated embodiment, however, in other embodiments the shoulder 216 may be level with the bottom 220 or may be above the bottom 220. The shoulder 216 has an outer diameter 222 (illustrated as a radius with respect to the axis 110) that is larger than an outer diameter 224 (illustrated as a radius with respect to the axis 110) of the leg 206, and moreover, larger than an outer diameter 226 (illustrated as a radius with respect to the axis 110) of the wing 212. However, it should be appreciated that the respective diameters 222, 224, 226 are for illustrative purposes only and that, in various embodiments, different diameters 222, 224, 226 may be larger than, smaller than, or equal to one another.

A recess 228 is formed into the seal 200 between the shoulder 216 and the wing 212. In various embodiments, a sabot 230 is arranged within the recess 228. The illustrated sabot 230 has an outer diameter 232 (illustrated as a radius with respect to the axis 110) that is larger than the outer diameters 222, 224, 226. As a result, the sabot 230 may be used to protect or centralize the seal 200 during installation or recovery. Moreover, the sabot 230 may protect the sealing surface 126 from damage during installation or removal. In various embodiments, in operation, the sabot 230 may contact the housing 202 as the seal 200 is lowered into the wellbore, the sabot 230 may be sized such that a gap 234 between the seal 200 and the housing 202 is maintained, thereby preventing the seal 200 from twisting and/or tilting within the wellbore and/or prevent the seal 200 from contacting and scratching the wellbore wall. Twisting and/or tilting of the seal 200 may lead to difficulties such as having the seal 200 get stuck within the wellbore and inefficient sealing between the hanger and the housing 202. Furthermore, maintaining the gap 234, for example due to the larger diameter 232, reduces the likelihood that the seal 200 will scrape against various locations in the downhole environment (e.g., at the wellhead, the BOP, along the sealing surfaces, etc.).

The sabot 230 includes platform 236 having a lip 238 that holds a bridge 240. The bridge 240 is arranged to contact the wing 212 and maintain the wing 212 in an outward or flexed position. For example, in various embodiments, the wing 212 may not flex when the seal 200 is energized, for example, due to stiffness of the wing 312. In various embodiments, the stiffness of the wing 312 in the hoop direction may be too high to be overcome when the legs are driven radially outward. The bridge 240, however, drives the wing 212 radially outward to facilitate deployment by transferring radial load at the open end of the wing 212. In the illustrated embodiment, the bridge 240 has a width 242 substantially equal to a width 244 of the platform 236 and constrained by the lip 238 to secure the bridge 240 to the sabot 230.

In various embodiments, the bridge 240 and the sabot 230 may be formed from different materials, thereby enabling the bridge 240 and sabot 230 to perform different functions. In embodiments, the sabot 230 may be considered a carrier such that the sabot 230 holds the bridge 240 in position to act on the wing 212. In various embodiments, the bridge 240 is formed from a material at least equally hard and strong as the seal 200 and/or wing 212, thereby facilitating force transfer to the wing 212. In other words, the bridge 240 may be formed from a material configured to carry radial loads (e.g., from the energizing ring) such that the bridge 238 does not substantially deform during setting of the seal 200. In contrast, the sabot 230 may be formed from a softer material, such as an elastomer, polymer, thermoplastic, or the like, to enable deformation of the sabot 230 when the seal 200 is set. It is desirable to have the sabot 230 formed from a material that is softer than the housing 202 such that contact between the sabot 230 and the housing 202 will deform or scratch the sabot 230 and not the housing 202, thereby maintaining the sealing surface 126. In various embodiments, the sabot 230 may be formed from a flowable material that expands upwardly toward the wing 212 to facilitate full deployment of the wing 212. In other words, in embodiments, the sabot 230 is not a volume compensating material, and rather, maintains a consistent volume that is deformed to fit within a void space 246 between the housing 202 and the recess 228. As will be described in detail below, in operation the energizing ring is installed within the opening 204 to apply a radial force to the leg 208. This radial force compresses the sabot 230, while the bridge 240 substantially maintains its shape. The compression of the sabot 230 deforms the sabot 230 such that the sabot 230 flows to fill the void space 246 and move upwardly, toward the wing 212. As a result, the sabot 230 may assist in deployment of the wing 212. It should be appreciated that, in various embodiments, the sabot 230 is not utilized as a pressure containing seal. That is, compression and deformation of the sabot 230 is not intended to act as a fluid or pressure barrier, in various embodiments.

Figure 3:
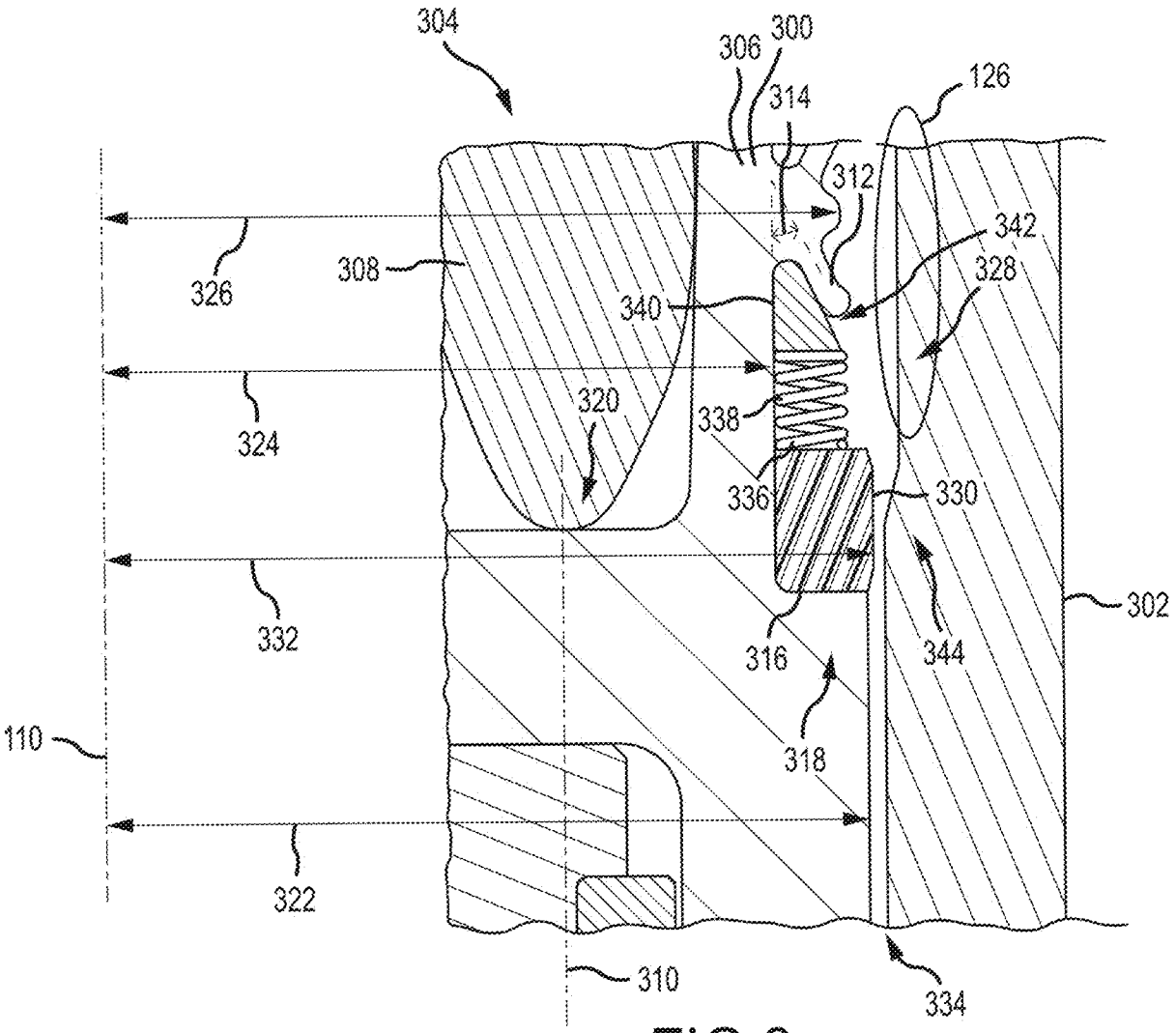
FIG. 3 is a cross-sectional side view of an embodiment of a seal including a sabot and bridge, in accordance with embodiments of the present disclosure.

FIG. 3 is a detailed cross-sectional view of an embodiment of a seal 300 arranged proximate a housing 302. The illustrated seal 300 is a U-type seal having an opening 304 that receives an energizing ring 308 to drive a leg 306 of the seal 300 radially outward from an axis 310 to thereby form a seal between the hanger 112 and the housing 302. It should be appreciated that another leg (not pictured) may be driven radially outward from the axis 310 in a direction opposite the leg 306. The illustrated seal 300 may be referred to as a wing-type seal because of the wing 312 that is positioned off of the leg 306 near the housing 302. The wing 312 is arranged at an angle 314 relative to the axis 310 and is flexible. That is, the wing 312 may be configured to expand or contract relative to the rest of the seal 300 based at least in part on pressures applied to the wing 312.

The seal 300 includes a shoulder 316 positioned at an outer edge 318 of the seal 300. The shoulder 316 is arranged below a bottom 320 of the opening 304 in the illustrated embodiment, however, in other embodiments the shoulder 316 may be level with the bottom 320 or may be above the bottom 320. The shoulder 316 has an outer diameter 322 (illustrated as a radius with respect to the axis 110) that is larger than an outer diameter 324 (illustrated as a radius with respect to the axis 110) of the leg 306, and moreover, larger than an outer diameter 326 (illustrated as a radius with respect to the axis 110) of the wing 312. However, it should be appreciated that the respective diameters 322, 324, 326 are for illustrative purposes only and that, in various embodiments, different diameters 322, 324, 326 may be larger than, smaller than, or equal to one another.

A recess 328 is formed into the seal 300 between the shoulder 316 and the wing 312. In various embodiments, a sabot 330 is arranged within the recess 328. The illustrated sabot 330 has an outer diameter 332 (illustrated as a radius with respect to the axis 110) that is larger than the outer diameters 322, 324, 326. As a result, the sabot 330 may be used to protect or centralize the seal 300 during installation or recovery. Moreover, the sabot 330 may protect the sealing surface 126 from damage during installation or removal and/or prevent the seal 300 from contacting and scratching the wellbore wall. In various embodiments, in operation, the sabot 330 may contact the housing 302 as the seal 300 is lowered into the wellbore, the sabot 330 may be sized such that a gap 334 between the seal 300 and the housing 302 is maintained, thereby preventing the seal 300 from twisting and/or tilting within the wellbore. Twisting and/or tilting of the seal 300 may lead to difficulties such as having the seal 300 get stuck within the wellbore and inefficient sealing between the hanger and the housing 302. Furthermore, maintaining the gap 334, for example due to the larger diameter 332, reduces the likelihood that the seal 300 will scrape against various locations in the downhole environment (e.g., at the wellhead, the BOP, along the sealing surfaces, etc.).

The sabot 330 includes top surface 336 having a biasing member 338 extending therefrom. The biasing member 338 holds a bridge 340. The bridge 340 is arranged to contact the wing 312 and maintain the wing 312 in an outward or flexed position. For example, in various embodiments, the wing 312 may not flex when the seal 300 is energized, for example, due to stiffness of the wing 312. In various embodiments, the stiffness of the wing 312 in the hoop direction may be too high to be overcome when the legs are driven radially outward. The bridge 340, however, drives the wing 312 radially outward to facilitate deployment by transferring radial load at the open end of the wing 312. In various embodiments, the biasing member 338 may be a spring, as illustrated in FIG. 3, applying an upward force to the bridge 340, which is transmitted to the wing 312. As a result, the wing 312 may remain in the flexed position. In the illustrated embodiment, the bridge 340 has a cone-shaped surface, formed by an outer surface illustrated as a frustum and an inner surface as a cylinder, such that the bridge 340 substantially conforms to a slot 342 formed between the wing 312 and a portion of the leg 306.

In various embodiments, as described above, the bridge 340 and the sabot 330 may be formed from different materials, thereby enabling the bridge 340 and sabot 330 to perform different functions. In embodiments, the sabot 330 may be considered a carrier such that the sabot 330 holds the bridge 340, via the biasing member 338, in position to act on the wing 312. In various embodiments, the bridge 340 is formed from a material at least equally hard and strong as the seal 300 and/or wing 312, thereby facilitating force transfer to the wing 312. In other words, the bridge 340 may be formed from a material configured to carry radial loads (e.g., from the energizing ring) such that the bridge 340 does not substantially deform during setting of the seal 300. In contrast, the sabot 330 may be formed from a softer material, such as an elastomer, to enable deformation of the sabot 330 when the seal 300 is set. It is desirable to have the sabot 330 formed from a material that is softer than the housing 302 such that contact between the sabot 330 and the housing 330 will deform or scratch the sabot 330 and not the housing 302, thereby maintaining the sealing surface 126. In various embodiments, as described above, the sabot 330 may be formed from a flowable material that expands upwardly toward the wing 312 to facilitate full deployment of the wing 312. In other words, in embodiments, the sabot 330 is not a volume compensating material, and rather, maintains a consistent volume that is deformed to fit within a void space 344 between the housing 302 and the recess 328. As will be described in detail below, in operation the energizing ring is installed within the opening 304 to apply a radial force to the leg 306. This radial force compresses the sabot 330, while the bridge 340 substantially maintains its shape. The compression of the sabot 330 deforms the sabot 330 such that the sabot 330 flows to fill the void space 344 and move upwardly, toward the wing 312. As a result, the sabot 330 may assist in deployment of the wing 312. It should be appreciated that, in various embodiments, the sabot 330 is not utilized as a pressure containing seal. That is, compression and deformation of the sabot 330 is not intended to act as a fluid or pressure barrier, in various embodiments.

Figures 4A, 4B, 4C:
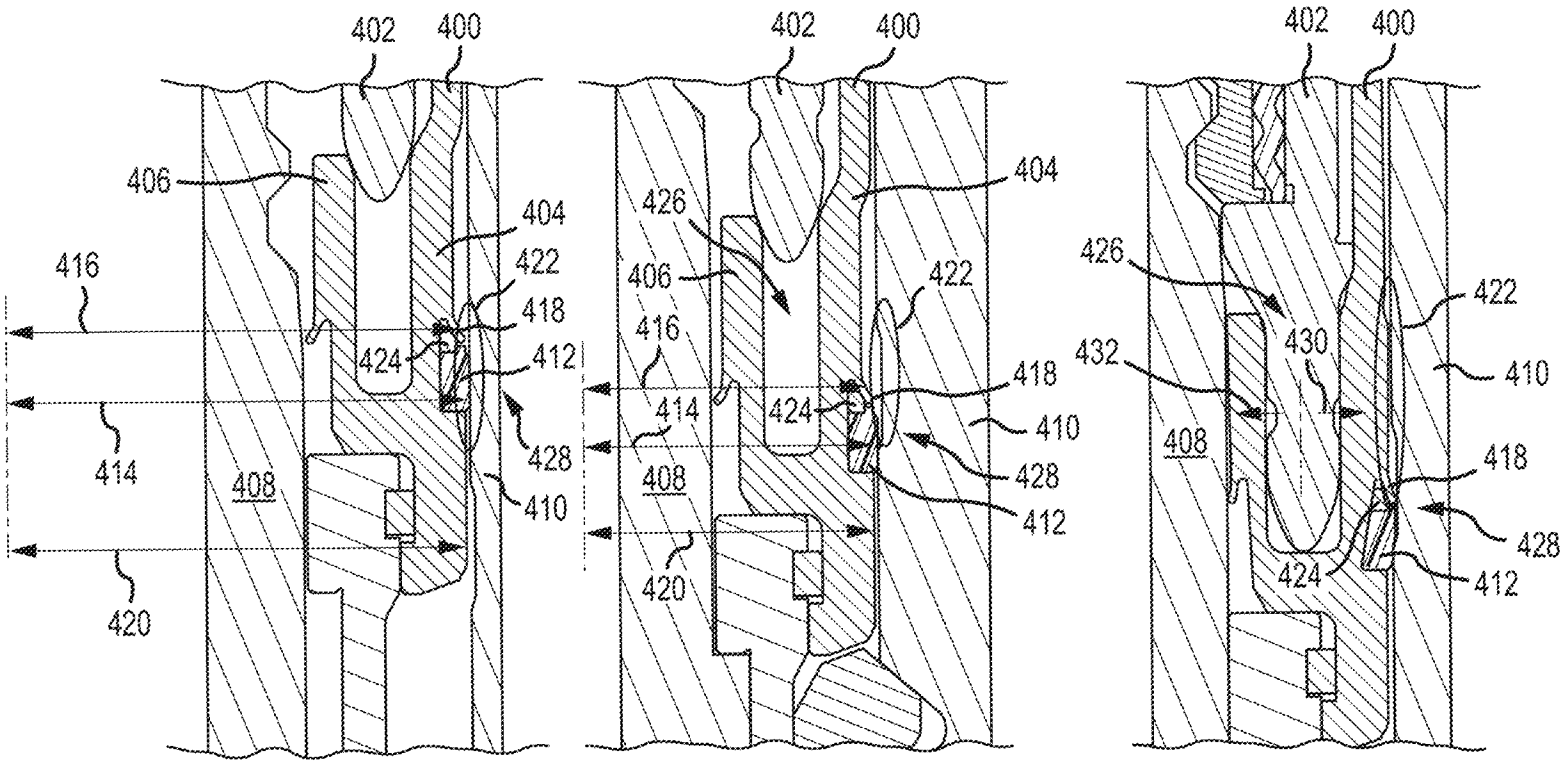
FIG. 4A is a cross-sectional side view of an embodiment of a sealing within a wellbore; in accordance with embodiments of the present disclosure.
FIG. 4B is a cross-sectional side view of an embodiment of a sealing arranged at a sealing location in a wellbore; in accordance with embodiments of the present disclosure.
FIG. 4C is a cross-sectional side view of an embodiment of a sealing in a set position; in accordance with embodiments of the present disclosure.

FIGS. 4A-4C are detailed cross-sectional views of a sequence where a seal 400 is energized via an energizing ring 402. As described above, in various embodiments the energizing ring 402 is utilized to apply a radial force to legs 404, 406 of seal 400, thereby compressing the legs 404, 406 against a hanger 408 and a housing 410. In the embodiment illustrated in FIG. 4A, the seal 400 is being lowered into the wellbore. The illustrated seal 400 includes a sabot 412, such as the sabot 230, 330 described with respect to FIGS. 2 and 3. In the illustrated embodiment, a larger sabot outer diameter 414 (illustrated as a radius with respect to the axis 110) is illustrated in contact with the housing 410 as the seal 400 is installed. As described above, in various embodiments, the sabot 412 includes the outer diameter 414 that is larger than an outer diameter 416 (illustrated as a radius with respect to the axis 110) at a wing 418 or an outer diameter 420 (illustrated as a radius with respect to the axis 110) of the seal 400 to reduce the likelihood of damage to one or more sealing surfaces 422 along the housing 410. For example, the sabot 412 may be formed from a softer material that does not scratch or otherwise damage the sealing surface 422. The illustrated embodiment further includes a bridge 424 that holds the wing 418 in an open or flexed position. The bridge 424 is supported by the sabot 412. In various embodiments, during installation, the sabot 412, bridge 424, or both may be split to facilitate installation.

FIG. 4B illustrates an embodiment where the seal 400 is arranged at a desired location and the energizing ring 402 is installed within an opening 426 in the seal 400. As described above, installation of the energizing ring 402 will apply a radial force to the legs 404, 406 to drive the legs 404, 406 against the sealing surfaces of the housing 410 and the hanger 408. In the embodiment illustrated in FIG. 4B, the deformation of the legs 404, 406 has not yet occurred. As illustrated, the sabot 412 is arranged in position proximate a void space 428 formed between the recess 228 (FIG. 2) in the seal 400 that receives the sabot 412 and the housing 410. It should be appreciated that while the illustrated embodiment includes a groove formed in the housing 410, that in other embodiments the groove may not be included.

FIG. 4C illustrates an embodiment where the seal 400 is set via insertion of the energizing ring 402 into the opening 426. As shown, outward radial forces 430, 432 are applied to the legs 404, 406. As a result of the radial forces 430, 432 the sabot 412 is compressed and expands within the void space 428 and further flows upwardly toward the wing 418. As described above, in various embodiments the sabot 412 is formed from a material that maintains its volumetric consistency. As a result, compression of the sabot 412 may facilitate deployment of the wing 418. Moreover, in embodiments, the sabot 412 is not utilized as a seal face or pressure containing component, but rather, as a component to enable deployment of the wing 418. As shown, the bridge 424, in the illustrated embodiment, has partially deformed due to the forces 430, 432. However, the position of the bridge 424 is maintained such that deployment of the wing 418 is enabled via the bridge 424.

Figure 5:
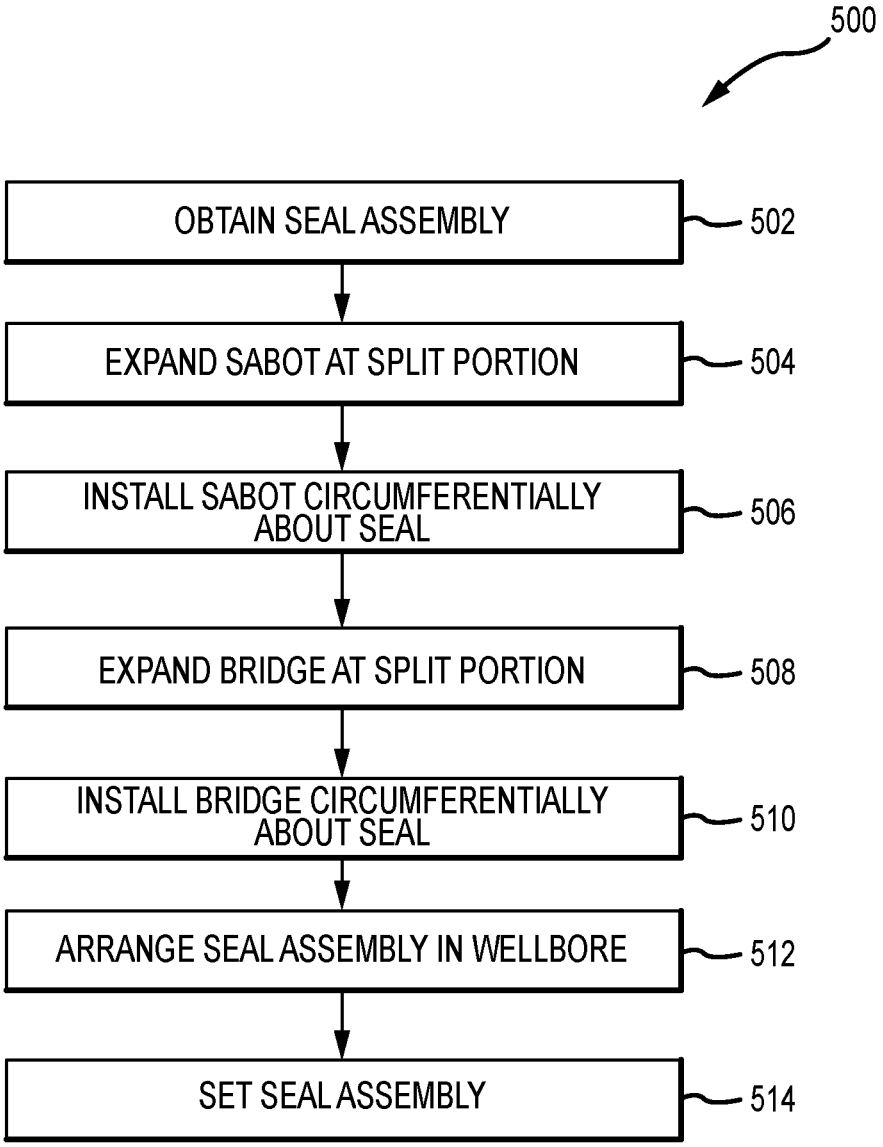
FIG. 5 is a flow chart of an embodiment of a method for setting a seal, in accordance with embodiments of the present disclosure.

FIG. 5 is a flow chart of an embodiment of a method 500 for setting a seal in a downhole environment. It should be appreciated for this method, and any methods described herein, that the steps may be performed in any order or in parallel, unless otherwise specifically stated. Moreover, the method 500 may include more, fewer, or alternative steps. In this example, a seal assembly is obtained (block 502). In various embodiments, the seal assembly may include the seal 200, 300, the sabot 230, 330, and/or the bridge 240, 340. It should be appreciated that a variety of components may be considered as being part of the seal assembly. The sabot 230, 330, may be split and expanded (block 504) for circumferential installation about the seal 200, 300 (block 506). As described above, in various embodiments, the sabot 230, 330 may be an annular ring that includes a split to enable installation over the seal 200, 300, for example, within the recess 228, 328. It should be appreciated that, in various embodiments, the sabot 230, 330 may also be formed directly onto the seal, for example, via injection molding or the like.

In embodiments, the bridge 240, 340, may be split and expanded (block 508) for circumferential installation about the seal 200, 300 (block 510). It should be appreciated that, in various embodiments, the bridge 240, 340 may also be formed directly onto the seal, for example, via injection molding or the like. As described above, in various embodiments, the bridge 240, 340 may be an annular ring that includes a split to enable installation over the seal 200, 300, for example, within the recess 228, 328. The seal assembly may be installed within the wellbore (block 512) and then set (block 514), for example via the energizing ring 402. In this manner, the sabot 230, 330 and the bridge 240, 340 may be utilized when setting the seal 200, 300 in the wellbore.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A system for setting a seal in a wellbore, comprising:

a sabot arranged proximate the seal, the sabot being supported by the seal and having a first diameter larger than a second diameter of the seal;

a bridge coupled to the sabot and in contact with the seal, the bridge extending axially away from the sabot and positioned within a slot formed by an extension of the seal; and an energizing ring that drives legs of the seal radially outward, the energizing ring applying a radial force to a leg proximate the sabot to at least partially deform the sabot, wherein the extension is a wing and the bridge drives the wing to a deployed position when the energizing ring applies the radial force to the leg.

2. The system of claim 1, wherein the sabot is formed from a volume-consistent material such that the sabot expands into a void space around the seal.

3. The system of claim 1, wherein the sabot is arranged on a shoulder formed on the seal and extends at least partially into a recess formed between the shoulder and the extension.

4. The system of claim 1, wherein the first diameter is larger than a third diameter of the extension.

5. The system of claim 1, further comprising a biasing member between the bridge and the sabot, the biasing member applying a reactive force in response to the radial force of the energizing ring.

6. The system of claim 1, wherein the sabot is formed from a softer material than the seal.

7. A wellbore system, comprising:

a housing arranged circumferentially about a wellbore;

a hanger arranged radially inward from the housing; and a sealing assembly between the housing and the hanger, the sealing assembly forming a pressure containing seal between the housing and the hanger, wherein the sealing assembly comprises:

a seal positioned between the housing and the hanger, the seal having a first leg proximate the housing, a second leg proximate the hanger, and an opening;

an energizing ring extending into the opening to drive the first leg and the second leg radially outward and into contact with the housing and the hanger, respectively;

a sabot positioned radially outward from the first leg and at least partially within a recess formed in the first leg, the sabot having a first diameter greater than second diameter of the seal, wherein the sabot is positioned on a shoulder formed at an outer edge of the seal, the shoulder having the second diameter that is smaller than the first diameter and being axially lower than an extension of the seal; and a bridge coupled to the sabot and axially higher than the sabot, the bridge engaging at least a portion of the seal.

8. The system of claim 7, wherein the extension is a wing coupled to the first leg.

9. The system of claim 7, wherein the sabot is formed from a material softer than a material forming the housing.

10. The system of claim 7, wherein the seal assembly further comprises a biasing member between the sabot and the bridge.

11. The system of claim 7, wherein a void space is formed between the seal and the housing when the seal is positioned at a desired location, the sabot being deformed by the first leg upon activation by the energizing ring such that the sabot expands into the void space.

12. The system of claim 11, wherein the deformed sabot flows in an axially uphole direction to apply a force to the bridge.

13. The system of claim 7, wherein the first diameter of the sabot blocks tilting of the seal when the seal is lowered to a desired location.

14. The system of claim 7, wherein the sabot is formed from a volume- consistent material comprising an elastomer, thermoplastic, or a combination thereof.

15. A method for installing a downhole seal, comprising:

obtaining a seal assembly;

obtaining a sabot sized for use with the seal assembly;

positioning the sabot circumferentially about a seal of the seal assembly;

installing the seal assembly within a wellbore;

engaging an extension of the seal via a bridge of the sabot;

driving the extension to a deployed position when the seal is activated via the bridge; and activating the seal between at least two wellbore components.

16. The method of claim 15, further comprising:

expanding a diameter of the sabot at a split.

17. The method of claim 15, further comprising:

forming a void space between the seal and at least one wellbore component;

deforming at least a portion of the sabot when the seal is activated; and filling at least a portion of the void space with the sabot.

* * * * *